US010197230B2

(12) United States Patent
Knapp et al.

(10) Patent No.: US 10,197,230 B2
(45) Date of Patent: Feb. 5, 2019

(54) LED LAMP WITH INTERNAL MIRROR

(71) Applicant: GE Lighting Solutions, LLC, East Cleveland, OH (US)

(72) Inventors: Thomas Alexander Knapp, Cleveland, OH (US); Jon Bennett Jansma, Pepper Pike, OH (US); Gary Robert Allen, Euclid, OH (US); Glenn Howard Kuenzler, Beachwood, OH (US); Bruce Richard Roberts, Mentor-on-the-Lake, OH (US)

(73) Assignee: GE Lighting Solutions, LLC, East Cleveland, OH (US)

( * ) Notice: Subject to any disclaimer, the term of this patent is extended or adjusted under 35 U.S.C. 154(b) by 0 days.

(21) Appl. No.: 15/557,655

(22) PCT Filed: Mar. 14, 2016

(86) PCT No.: PCT/US2016/022362

§ 371 (c)(1),
(2) Date: Sep. 12, 2017

(87) PCT Pub. No.: WO2016/145448

PCT Pub. Date: Sep. 15, 2016

(65) Prior Publication Data

US 2018/0066811 A1 Mar. 8, 2018

Related U.S. Application Data

(60) Provisional application No. 62/132,460, filed on Mar. 12, 2015.

(51) Int. Cl.
*F21K 9/68* (2016.01)
*F21K 9/66* (2016.01)
(Continued)

(52) U.S. Cl.
CPC ..... *F21K 9/68* (2016.08); *F21K 9/232* (2016.08); *F21K 9/238* (2016.08); *F21K 9/66* (2016.08);
(Continued)

(58) Field of Classification Search
CPC ... F21K 9/68; F21K 9/232; F21K 9/66; F21V 23/005; F21Y 2115/10
See application file for complete search history.

(56) References Cited

U.S. PATENT DOCUMENTS 6,635,987 B1 * 10/2003 Wojnarowski ..... H01L 25/0753 257/E25.02
8,933,619 B1 1/2015 Ou
(Continued)

FOREIGN PATENT DOCUMENTS

| | | | |
|---|---|---|---|
| CN | 103292179 | A | 9/2013 |
| CN | 103883896 | A | 6/2014 |
| WO | 2011/069437 | A1 | 6/2011 |

OTHER PUBLICATIONS

International Search Report and Written Opinion issued in connection with corresponding PCT Application No. PCT/US2016/022362 dated May 17, 2016.
(Continued)

*Primary Examiner* — Tracie Y Green
(74) *Attorney, Agent, or Firm* — Peter T. DiMauro; GPO Global Patent Operation

(57) ABSTRACT

The present disclosure provides a lamp assembly (200), comprising a base (202), an outer jacket (204) mounted to the base (202), a first reflective substrate (206, 208) positioned within the outer jacket (204), and a first solid-state light source (220) disposed proximate the first reflective
(Continued)

substrate (206, 208). The outer jacket (204) may be glass. The outer jacket (204) may hermetically seal the first solid-state light source (220).

20 Claims, 12 Drawing Sheets

(51) Int. Cl.

| | |
|---|---|
| ***F21K 9/232*** | (2016.01) |
| ***F21V 3/04*** | (2018.01) |
| ***F21V 7/05*** | (2006.01) |
| ***F21V 23/00*** | (2015.01) |
| ***F21K 9/238*** | (2016.01) |
| *F21V 3/02* | (2006.01) |
| *F21W 121/00* | (2006.01) |
| *F21Y 115/10* | (2016.01) |
| *F21Y 107/00* | (2016.01) |

(52) U.S. Cl.
CPC ..... *F21V 3/04* (2013.01); *F21V 7/05* (2013.01); *F21V 23/005* (2013.01); *F21V 3/02* (2013.01); *F21W 2121/00* (2013.01); *F21Y 2107/00* (2016.08); *F21Y 2115/10* (2016.08)

(56) References Cited

U.S. PATENT DOCUMENTS

| | | | | |
|---|---|---|---|---|
| 8,953,926 | B1 * | 2/2015 | Kelly | H05B 33/02 362/335 |
| 2009/0135595 | A1 | 5/2009 | Chen | |
| 2014/0119007 | A1 | 5/2014 | Edmond et al. | |
| 2014/0268771 | A1 * | 9/2014 | Heikman | F21V 29/004 362/249.02 |
| 2014/0268779 | A1 * | 9/2014 | Sorensen | F21K 9/232 362/249.06 |

OTHER PUBLICATIONS

International Preliminary Report on Patentability issued in connection with corresponding PCT Application No. PCT/US2016/022362 dated Sep. 12, 2017.

Knapp, T.A., et al., LED Lamp with Internal mirror, GE U.S. Appl. No. 62/132,460, filed Mar. 12, 2015.

* cited by examiner

LED LAMP WITH INTERNAL MIRROR

CROSS REFERENCE

This application claims priority under 35 CFR 119(e) and benefit from prior filed, commonly-owned U.S. provisional patent application 62/132,460, filed 12 Mar. 2015, the contents of which are hereby expressly incorporated by reference.

FIELD

The aspects of the disclosed embodiments relate to LED lamps, and in particular, to an LED lamp having at least one LED light source proximate a reflective surface inside the bulb.

BACKGROUND

Incandescent light bulbs create light by conducting electricity through a resistive filament and heating the filament to a very high temperature to produce visible light. Incandescent bulbs are made in a wide range of sizes and voltages. The bulbs typically include an enclosure with a tungsten filament inside and a base connector that provides both an electrical and structural support connection. Incandescent bulbs generally mate with a lamp socket having a threaded Edison base connector, bayonet base connector, pin base connector, or any suitable connector for providing electrical power to the bulb. However, incandescent light bulbs are generally inefficient and require frequent replacement. These lamps are in the process of being replaced by more efficient types of electric light such as fluorescent lamps, high-intensity discharge lamps, and, in particular, LED light sources.

LED technology continues to advance resulting in improved efficiencies and lower costs with LED light sources found in lighting applications ranging from small pin point sources to stadium lights. An LED light may be 60-70% more efficient than an incandescent light but may still generate significant amounts of heat. At higher temperatures, light conversion efficiency for an LED light source may drop as power increases, the LED life decreases, and the light output from the LED may be permanently diminished.

An LED light source is generally chip mounted and heat is conducted away through a heat sink. Existing light fixtures are largely adapted to dissipate radiated heat and usually have very little capacity to dissipate conducted heat. In order to reach desired lumen values and maintain compatibility with a significantly large installed base of presently existing fixtures, additional cooling techniques may be required. It would be advantageous to provide an LED lamp that closely resembles an incandescent lamp in light output and aesthetics, with the high efficacy and life of an LED light source.

A variety of LED lamps with full glass outer jackets in A-line and candelabra embodiments have been introduced. While these products preserve the incandescent aesthetic, they are often not dimmable. LED lamps that are dimmable typically have poor dimmability (e.g. small dimmable range of only 100% to ~50%, and/or noisy operation while dimmed) and/or low power factor (e.g. 0.4-0.6).

Additionally, in some cases LED lamp products do not meet UL (Underwriters Laboratories) standards because the LEDs do not self-extinguish if the glass bulb is broken. LED lamps that are receiving UL approval have the glass bulb coated with silicone so the glass is shatter resistant.

Accordingly, it would be desirable to provide LED lamps that solve at least some of the problems identified above.

SUMMARY

The aspects of the disclosed embodiments are directed to an LED lamp (or "lamp assembly") having a bulb or outer envelope, and both a plurality of LEDs and associated LED driver are placed in a position in the interior of the bulb to be encapsulated (e.g., hermetically encapsulated) by the bulb. In the disclosed embodiments, the LED driver is not outside the bulb (e.g., not in a capper portion of the lamp). The LED lamps of the disclosed embodiments may use, but are not limited to, filament-style LEDs which more closely resemble incandescent filaments. A circuit board, for example, a printed circuit board (PCB), may be placed within the bulb of the LED lamp. To promote a particular aesthetic look, the PCB may be masked with a reflective (e.g., mirror-like) coating or panel(s), and thus the incandescent-like aesthetic look may be preserved. Also, placing the driver within the interior of the bulb gives much more flexibility to include components that may enhance lamp performance, such as a fuse that will extinguish the lamp if a glass bulb is broken. As used herein, the term "bulb" may generally mean the same as "envelope" or "jacket".

In at least one aspect, the disclosed embodiments are directed to a lamp assembly including a base, an outer jacket or envelope mounted to the base, a first reflective substrate positioned within the outer jacket, and a first solid-state light source disposed proximate the first reflective substrate.

The outer jacket may be formed of glass.

The outer jacket may comprise a polymer.

The outer jacket may also comprise a translucent ceramic.

The first solid-state light source may be an LED light source.

The first solid-state light source may be an LED filament light source.

The first solid-state light source may be mounted within a cutout of a first reflective substrate.

The first reflective substrate may have a specular surface reflectance.

The first reflective substrate may have a diffuse surface reflectance.

The first reflective substrate may have a combination specular and diffuse surface reflectance.

The first reflective substrate may be mounted on a printed circuit board.

The lamp assembly may include a second reflective substrate positioned within the outer jacket and a second solid-state light source disposed on the second reflective substrate.

The first reflective substrate may be mounted on a first face of a printed circuit board and the second reflective substrate may be mounted on a second face of the printed circuit board.

The second reflective substrate may be disposed in a stand-off relationship with the second face of the printed circuit board.

The lamp assembly may also include a second reflective substrate positioned within the outer jacket, a second solid-state light source disposed on the second reflective substrate, a third reflective substrate positioned within the outer jacket, and a third solid-state light source disposed on the second reflective substrate.

The first reflective substrate may be mounted between the second and third reflective substrates and the first solid state light source may be mounted within a cutout of the first reflective substrate. These and other aspects and advantages of the exemplary embodiments will become apparent from the following detailed description considered in conjunction with the accompanying drawings. It is to be understood, however, that the drawings are designed solely for purposes of illustration and not as a definition of the limits of the disclosed embodiments. Additional aspects and advantages of the disclosed embodiments will be set forth in the description that follows, and in part will be obvious from the description, or may be learned by practice of the disclosed embodiments. Moreover, the aspects and advantages of the disclosed embodiments may be realized and obtained by means of the instrumentalities and combinations particularly pointed out in the appended claims.

DETAILED DESCRIPTION

Figure 1:
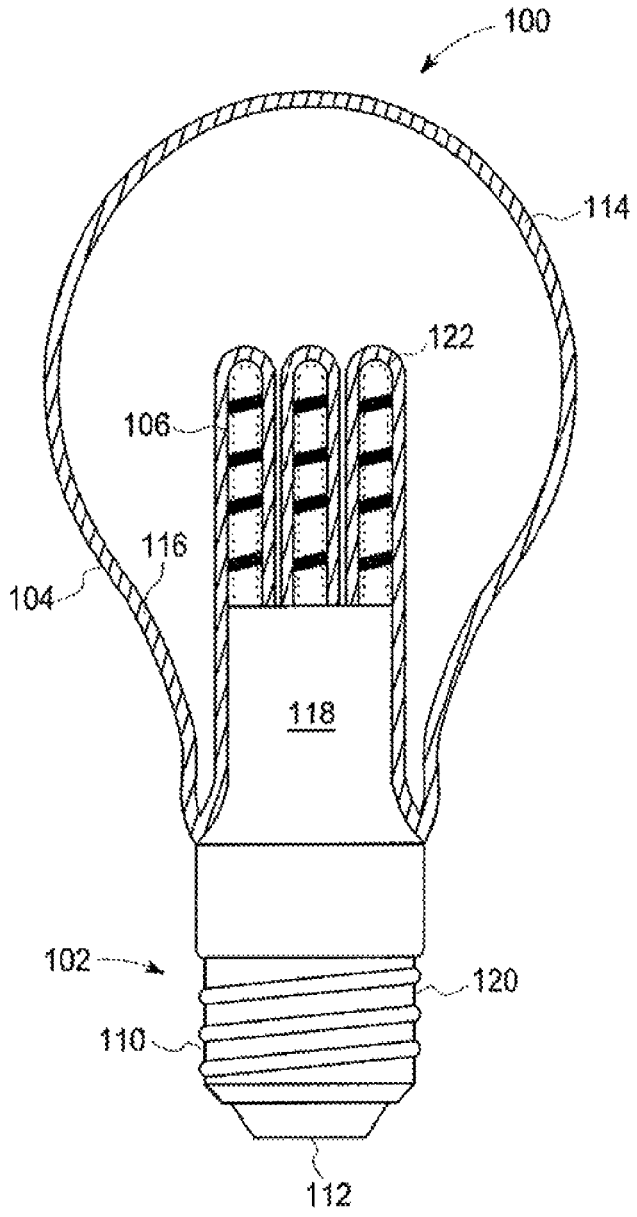
FIG. 1 is a schematic diagram of a typical LED lamp.

FIG. 1 is a schematic diagram of a typical LED light bulb 100. The light bulb 100 may include a base 102, an envelope 104, and an LED light source 106, which may be mounted on an extension 118 of the base 102. While the aspects of the disclosed embodiments are generally described herein with respect to an LED light source, the aspects of the disclosed embodiments apply to any suitable solid-state light source. As used herein, the term "solid-state light source" (or SSL source) includes, but is not limited to, light-emitting diodes (LEDs), organic light-emitting diode (OLEDs), polymer light-emitting diodes (PLEDs), laser diodes, or lasers. In addition, although the figures depict LED light sources, it should be understood that other types of SSL sources could be utilized in some embodiments in accordance with the novel implementations described herein. While some of the disclosed embodiments are described as utilizing LED filaments or LED filament assemblies, it should be understood that the disclosed embodiments are not limited to using LED filaments and may use any SSL source. Some examples of alternatives to LED filament light sources, may comprise a plurality of LEDs mounted on a board. Thus, it is specifically contemplated that occurrences of LED filament light sources explained within embodiments of this disclosure, may be replaced by a plurality of LEDs mounted on a board.

The extension of the base 102 may be implemented as a light source support 118, and the base may further include a base connector 120. The base connector 120 may include electrical contacts, for example contacts 110, 112, for supplying electrical power to the LED light bulb 100 from an external power source or power supply. In at least one embodiment, contact 110 may be a threaded contact and contact 112 may be a button contact forming a standard Edison base connector. Contacts 110, 112 may connect to a standard 120V or 230V A.C. mains supply or any other suitable external power source. While an E26 base connector is illustrated, it should be understood that the LED lamp assembly of the disclosed embodiments may include any E style connector, for example, E11, E12, E17, any bayonet, screw, single or double contact, or mogul connector, or any base connector.

The envelope 104 may generally enclose the LED light source 106 and may be constructed of glass, polymer, plastic, translucent ceramic, or other suitable material for transmitting light and for confining the cooling medium within the envelope 104. While an "A" type envelope is shown, it should be understood that the LED lamps assembly of the disclosed embodiments may include AR, B, BR, C, E, ER, G, K, MB, MR, PAR, R, S, T, or any suitable envelope shape. For example, an "A" type envelope refers to a classic Edison envelope, a "B" type envelope refers to a candle shaped envelope, a "G" type envelope refers to a globe shaped envelope, an "R" type envelope refers to a reflector envelope, and a "T" type envelope refers to a tube shaped envelope. However, while certain types of envelopes are referenced herein, the LED lamps assembly of the disclosed embodiments may utilize any appropriate envelope profile.

A surface of envelope 104 may inherently diffuse light or may include frosting, texturing, a light diffusing coating, embedded light scattering particles, or other material for diffusing light. The envelope may also be referred to, elsewhere in this disclosure, as a "bulb" or "outer jacket". In many important embodiments, the envelope 104 may be hermetically sealed and confine a cooling medium 116, for example, a gaseous cooling medium (which may comprise helium and/or hydrogen), or an evaporating fluid. In some embodiments, the cooling medium (also referred to a thermally conductive medium or cooling fluid) may be a non-oxidative gas with a relatively high thermal conductivity.

The LED light source 106 of FIG. 1 may include one or more LEDs (not individually shown) generally mounted on a substrate on light source support 118 within envelope 104. The LEDs may include a multi-color white arrangement of a combination of red, green, and blue LEDs; near UV or UV LEDs in combination with an RGB phosphor; blue LEDs in combination with a yellow phosphor; white LEDs; or any suitable arrangement of LEDs; and, if required, any suitable material 122 for converting the LED output to substantially white light, e.g., broad spectrum white light.

Figure 2:
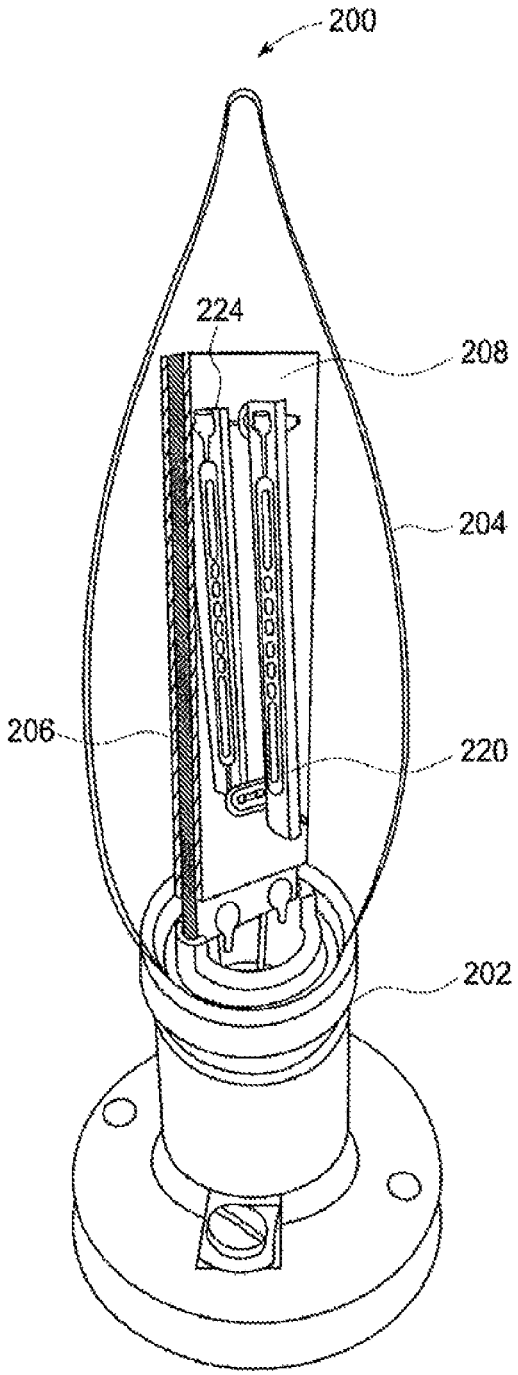
FIG. 2 illustrates a perspective view of an exemplary LED lamp assembly incorporating aspects of the disclosed embodiments.

Referring to FIG. 2, a perspective view of an exemplary LED lamp assembly 200 of the disclosed embodiments is shown. In this illustrative embodiment, the LED lamp assembly may include a CA10 candelabra lamp having an E12 base 202 (i.e. candle base), a glass outer jacket or bulb 204, and a substrate in the form of a printed circuit board 206 (PCB) centered inside the bulb 204 and disposed lengthwise along the vertical axis. An LED filament 220 may be disposed on or proximate the PCB 206 in the bulb 204. The PCB 206 may comprise a reflective surface 208, which may further comprise a mirror-like coating, surface or panel. In many embodiments of this disclosure, the lamp may also comprise other shapes, such as A-type, B-type, etc.

Figure 3:
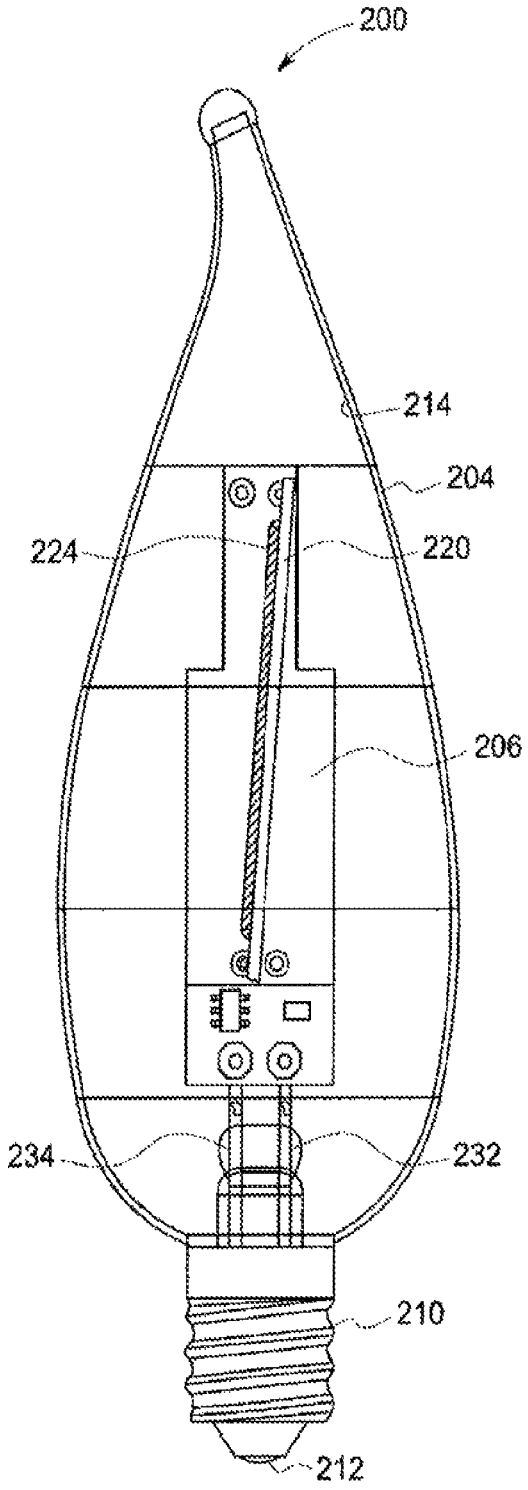
FIG. 3 illustrates a front view of an exemplary LED lamp assembly incorporating aspects of the disclosed embodiments.
Figure 10:
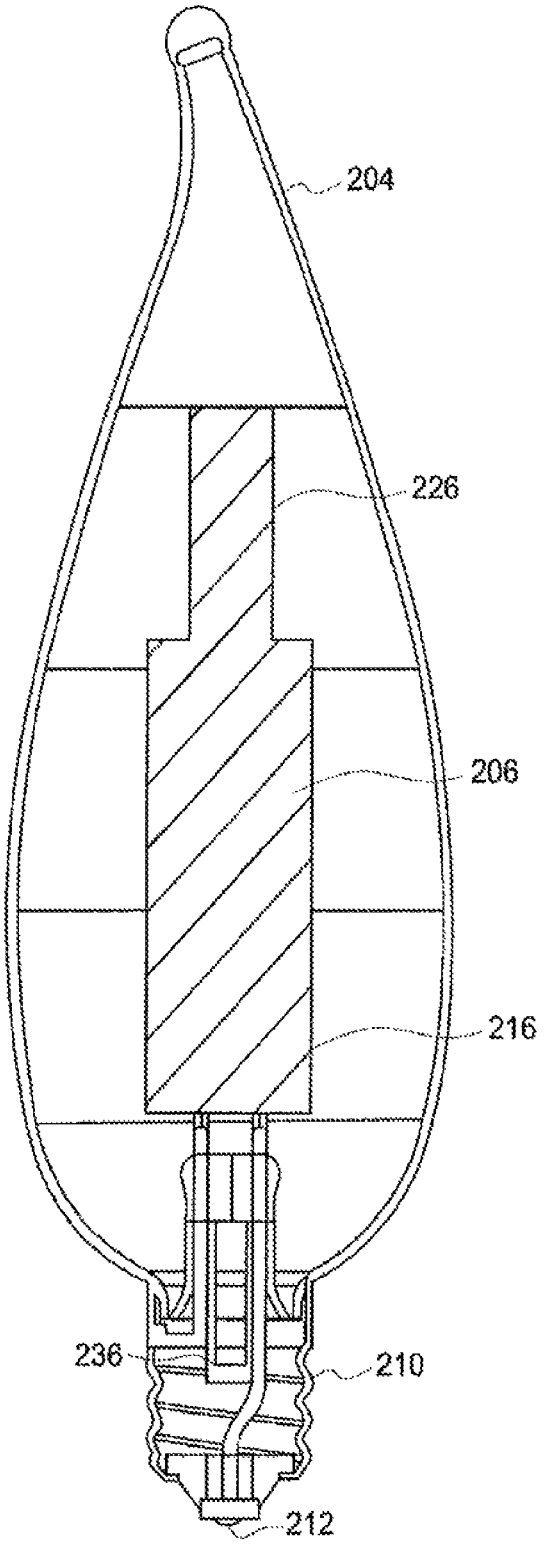
FIG. 10 illustrates a section view of the exemplary LED lamp assembly shown in FIG. 3.

FIG. 3 illustrates a front view of one embodiment of an LED lamp assembly 200 incorporating aspects of the present disclosure. In the embodiment shown in FIG. 3, the LED lamp assembly 200 may include contacts 210, 212 and leads 232 and 234. The contacts 210, 212 and leads 232, 234 may be used to provide electrical power to the LED lamp assembly 200. FIG. 10 illustrates a cross-sectional view of the LED lamp assembly 200 shown in FIG. 3.

Figure 4:
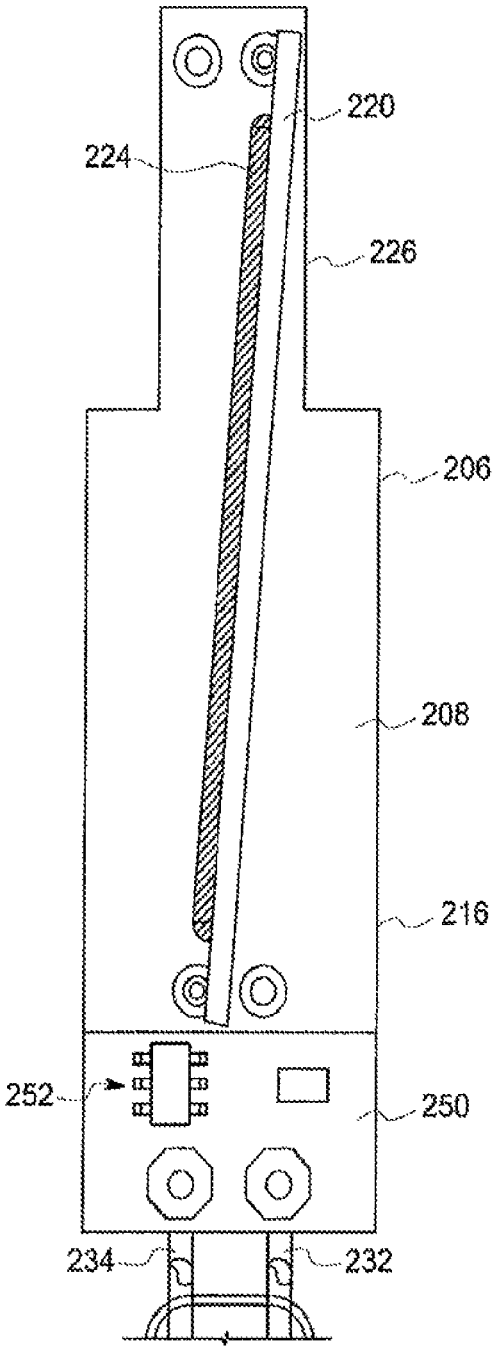
FIG. 4 illustrates the exemplary LED lamp assembly of FIG. 3, without the glass bulb and base section.

FIG. 4 illustrates the LED lamp assembly 200 of FIG. 3 without the glass bulb 204. In this embodiment, the shape of the PCB 206 may be substantially rectangular, with a bottom portion 216 of the PCB 206 being generally wider than the top portion 226. Although a rectangular shape is illustrated in FIG. 4, the PCB 206 of the disclosed embodiments can comprise different shapes. Examples of these shapes can include, but are not limited to, a rectangular PCB; a PCB that is tapered to shorter width towards a top of the PCB; a candle flame-shaped PCB; or a rounded PCB.

Figure 5:
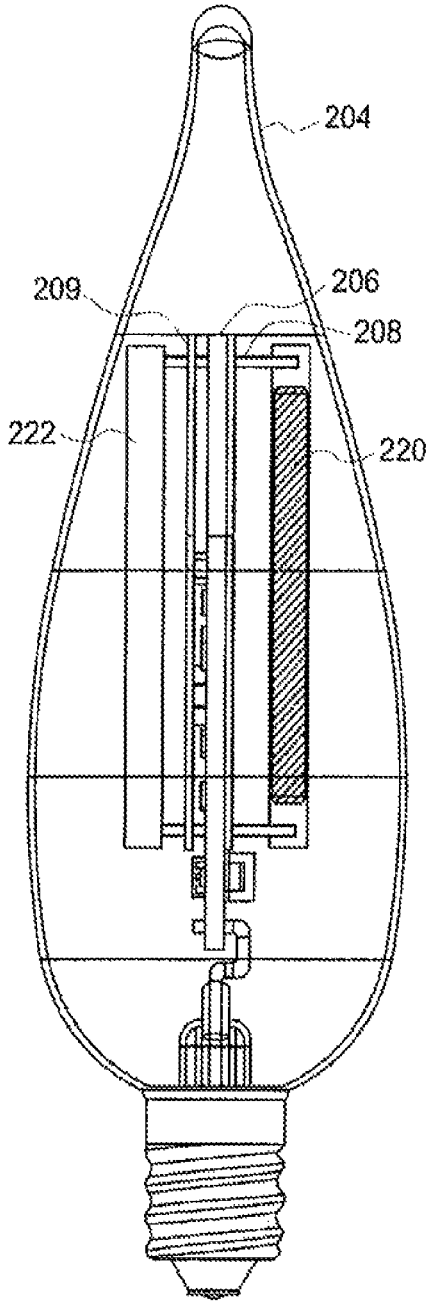
FIG. 5 illustrates a side view of an exemplary LED lamp assembly incorporating aspects of the disclosed embodiments.
Figure 6:
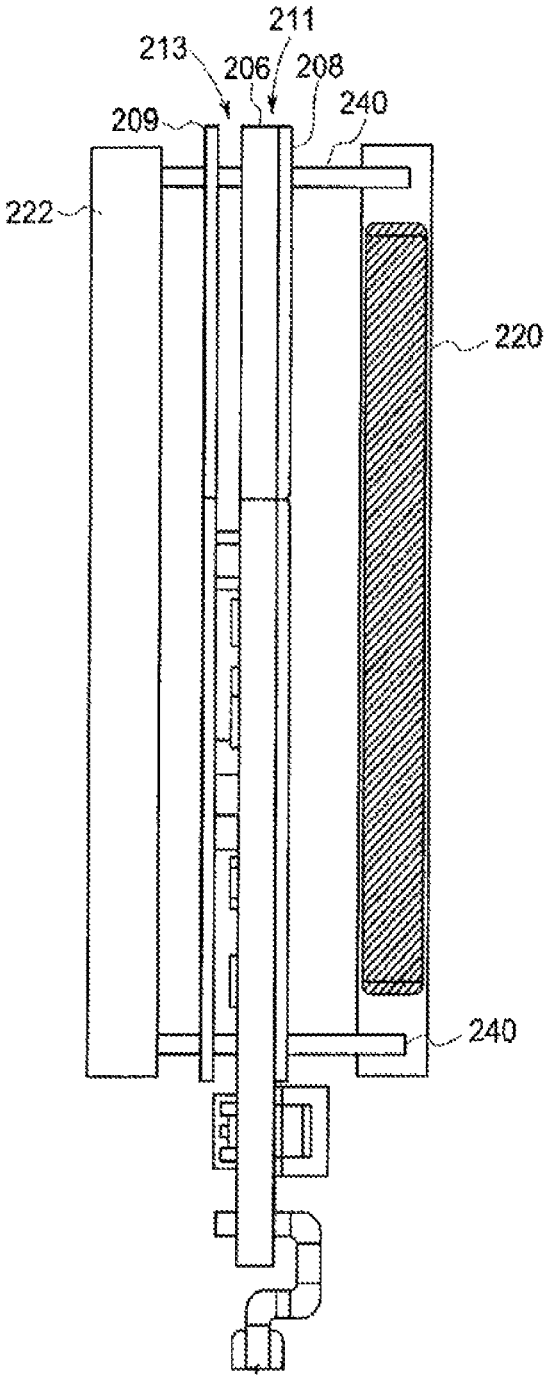
FIG. 6 illustrates the exemplary LED lamp assembly of FIG. 5 without the glass bulb and base section.

FIGS. 5 and 6 illustrate a side view of the exemplary LED lamp assembly shown in FIG. 3. Referring to FIGS. 5 and 6, a reflective surface 208, also referred to herein as a mirror-like coating, surface or panel, may cover at least a portion of one or more faces of the PCB 206. The PCB 206 may generally comprise a first face 211 and a second face 213. The second face 213 in this example may have electrical circuit components for the LED driver mounted thereon.

In the example shown in FIGS. 5 and 6, only the first face 211 of the PCB 206 may include the reflective surface 208. A reflective panel 209 may be disposed in a stand-off relationship with the second face 213 to avoid interference with the electrical components mounted on the PCB 206. In one embodiment, the reflective panel 209 can include a reflective surface 208. In alternate embodiments, one or both sides or faces 211, 213 of the PCB 206 can include the reflective surface 208.

The reflective surface 208 may generally comprise any suitable light reflective coating or panel, such as a reflective foil for example. In one embodiment, the reflective surface 208 may comprise a substrate with a coating that creates a surface with a high reflectance. The reflective surface 208 may have a reflectance greater than 50%, more preferably >80%, most preferably >90%. The surface reflectance may be either specular, or diffuse, or a combination of specular and diffuse. Specular reflectance may provide a mirror-like finish such that the images of the LEDs reflected from the surface will appear to an observer to be additional LEDs. Diffuse reflectance may provide a flat, hazy or matte finish such that the images of the filaments reflected from the surface will not be apparent to an observer, providing a more uniformly lit appearance.

The highly reflective surface may be the surface of a substrate, which may be the PCB itself, or it may be the surface a separate foil or panel made of plastic, metal, ceramic, glass, cured resin, or other material having an intrinsic high reflectance. Alternatively, the highly reflective surface may be the surface of a coating applied to the substrate, where the substrate may be the PCB itself, or it may be the surface of a separate foil or panel made of plastic, metal, ceramic, glass, cured resin, or other material suitable for receiving a coating. The means of coating may be painting, spraying, electrostatic coating (i.e. powder-coating) of highly reflective material; or it may be application of an optical interference film provided by sputtering or physical vapor deposition or chemical vapor deposition, or other suitable means of providing high reflectance to the surface of the substrate. A specular coating may comprise aluminum, silver, nickel, zinc or other metal of suitably high reflectance or it may be an interference thin film that may comprise combinations of materials having high and low index of refraction, typically but not limited to metal oxide materials. Further, the metal coating may be clear coated with silicone, lacquer, metal oxide thin film, or other sufficiently clear substance that protects the metal finish and/or insulates the metal from any electrical conductors in the vicinity of the reflective surface. A diffuse coating may comprise a paint, powder, plastic, metal, ceramic, glass, cured resin, or other material having an intrinsic high reflectance.

The LED lamp assembly 200 may include at least one LED filament 220. The LED filament 220 may generally comprise any suitable LED filament or array of LEDs. In one embodiment, the LED filament 220 may comprise a substantially linear array of LED filaments. The exemplary filament 220 of the disclosed embodiments may have an approximately 1 mm thick by 2.5 mm wide by ~28 mm long substrate. In alternate embodiments, the filament 220 can comprise any suitable length, such as for example approximately 38 mm. If the LED array employs a mixture of phosphor and polymeric encapsulant (e.g., silicone) disposed over LED chips, then this mixture may be any suitable height, e.g., about 0.7 mm. In general, a longer filament 220 may be preferred since it may increase the surface area in contact with the cooling fluid and improves thermal performance. However, the length of the filament also affects the overall aesthetic of the lamp, so a longer filament may perform more efficiently but have less favorable appearance to an observer. Of course, the presently disclosed embodiments are not limited to the candelabra profile, and are not limited to LEDs in filament shape.

The LED assembly 200 of the disclosed embodiments can include more than one filament 220. For example, as shown in FIGS. 5 and 6, the LED assembly 200 can include a second LED filament 222. The LED filament 222 may generally be the same as the LED filament 220, and may be disposed on another side of the PCB 206. Light may be emitted out of both sides of the filament since the substrate of the filament itself is typically transparent or translucent.

Figure 7:
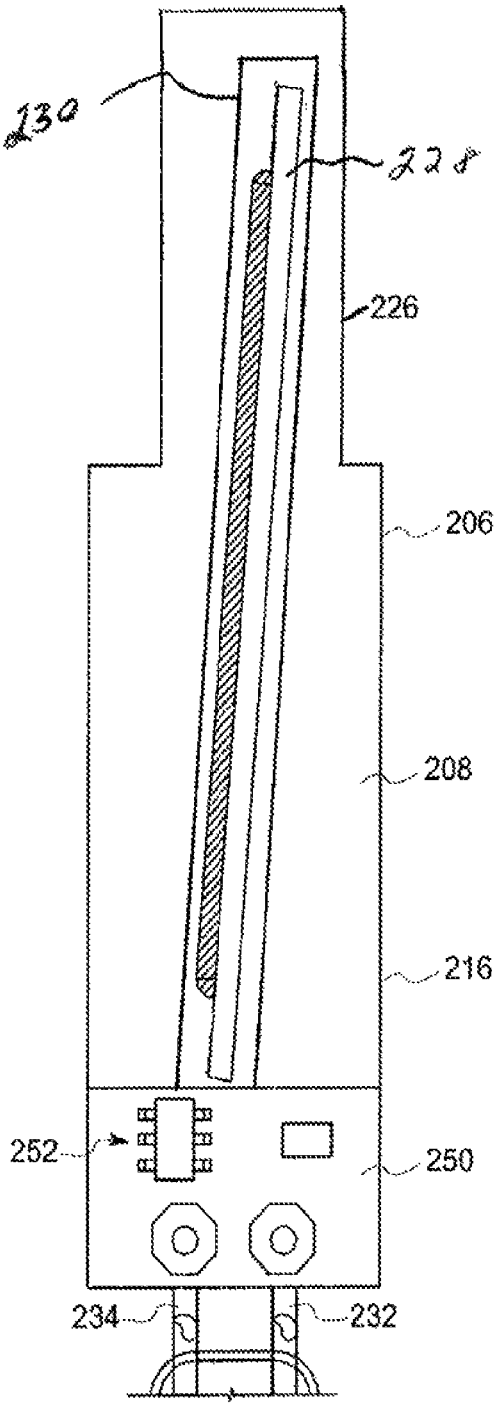
FIG. 7 illustrates an exemplary LED lamp assembly incorporating aspects of the disclosed embodiments.

A single filament embodiment is shown in FIG. 7 and may have a filament 228 in the middle of the lamp, within a cutout 230 of the PCB 206. In this embodiment, the PCB 206 may still have reflective surfaces so that reflections of the filament light source from the inside of the glass bulb 204 may be reflected further from the PCB 206.

Figure 8:
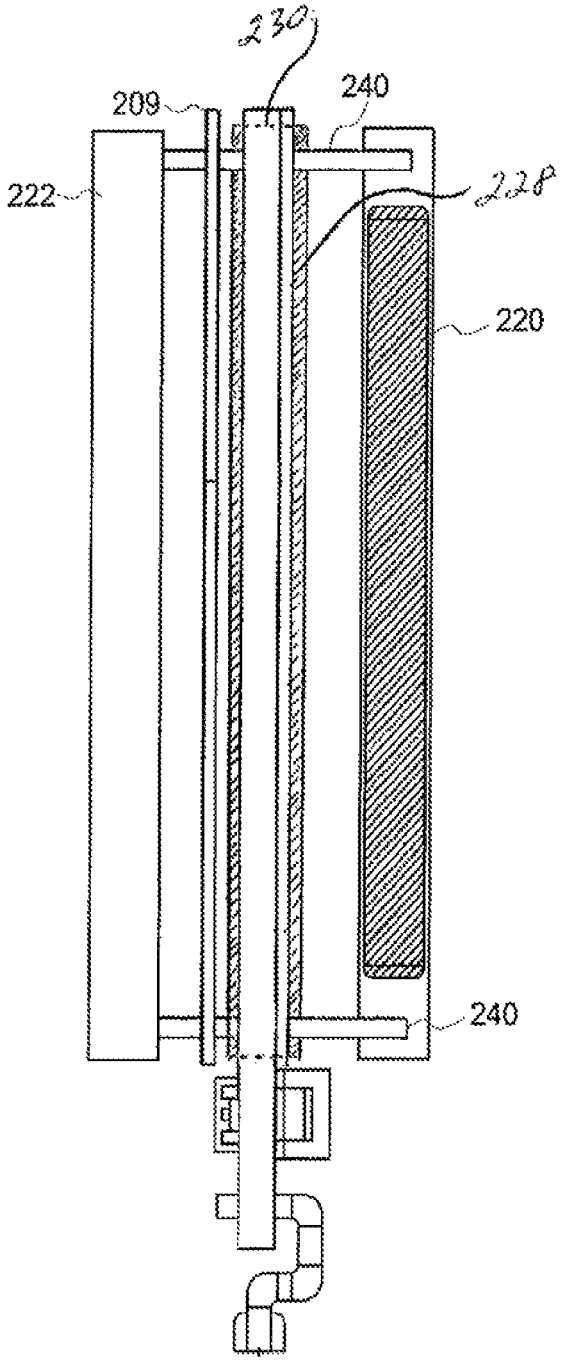
FIG. 8 illustrates another exemplary LED lamp assembly incorporating aspects of the disclosed embodiments.

A three filament embodiment, illustrated in FIG. 8, may combine the central filament 228 within the PCB cutout 230 with the two spaced-apart filaments 220, 222. Such an embodiment may maintain symmetry while boosting light output. A three filament embodiment could have all three filaments 220, 222, 228 at the same correlated color temperature (CCT), or could have a different CCT. For example, two of the three filaments may be at the same CCT, and the middle filament 228 at a different CCT. By incorporating a central filament 228 with a different CCT, the lamp can dynamically change CCT as it dims. The benefit of changing CCT dynamically is that it mimics the behavior of incandescent filaments. As incandescent bulbs dim from 100% to 0%, their CCT level also diminishes. At full brightness the bulb may be at CCT=2700K or 3000K (warm white). As the bulb dims, the CCT may drop to 2000K or even lower (red-orange). The diminishing CCT may resemble a sunset in which the light begins as warm white during the dimming process, then becomes more orange, then stabilizes at around orange-red. This effect is known as incandescent-like dimming, warm dimming, sunset-like dimming, or dynamic dimming.

In some applications, it may be desired to use a single filament on one or both sides of the PCB 206. Alternatively, more than one LED or LED array can be used to make up an LED filament 220. For example, the LED filament 220 can comprise two or more LED arrays or filaments coupled together to form the LED filament 220. Generally, the LED filament 220 can comprise any suitable arrangement of LEDs, as is generally understood.

Referring to FIG. 6, for example, the LED filament 220 may be disposed proximate the reflective surface 208 of the PCB 206 so that the light generated by the filament 220 may be reflected by the reflective surface 208. As is shown in FIG. 6, standoffs or supports or prongs 240 may be used to support the LED filament 220 away from the reflective surface 208. In one embodiment, a suitable range of standoff distances may be approximately 1-10 mm. The supports 240 may also incorporate electrical leads or wires (not shown) to supply electrical current to the filament(s).

The aspects of the disclosed embodiments may eliminate the need for an insulating housing around the PCB 206. Conventionally, a "capper" is used as an insulating housing for circuit boards in lamps. However, in aspects of the present disclosure, the PCB 206 may be placed into the interior region of the bulb 204 and may be hermetically sealed within.

Referring to FIG. 4, the PCB 206 may generally comprise an LED driver, or LED driver board 250. The PCB 206 may generally include surface area for mounting components 252 that may comprise an LED driver (e.g., a dimmable LED driver). The quantity and size of the electrical components may drive the size of the PCB 206 such that the PCB 206 may sometimes be taller and wider than the LED filament 220 in the lamp assembly 200. In one embodiment, the dimensions of the exemplary PCB 206 may be approximately 46 mm long×12 mm wide×1.6 mm thick. At the top portion 226 of the PCB 206, which in one embodiment may have a length of approximately 15 mm, the width may be decreased to approximately 6 mm.

The reflective surface 208 may mimic the shape of the PCB 206. Alternatively, the reflective surface 208 may be slightly larger, may be slightly smaller, and may have selective holes, slots, or cuts to avoid contact with electrically conductive components.

In an embodiment, as shown in FIG. 2, an observer looking into the lamp assembly 200 at certain angles may generally see only one LED filament 220. Referring to FIG. 5, in one embodiment, the other filament 222 may be obstructed by the PCB 206. As illustrated in FIGS. 2, 3 and 4, by adding a mirror-like panel or coating or reflective surface 208 to the PCB 206, a virtual image 224 (or reflection) of the filament 220 may be generated, and may be perceived to be on the opposite side of the PCB 206, when the LED lamp assembly 200 is viewed substantially from the front or rear. It will be understood that viewing the LED lamp assembly 200 from certain side angles (from approximately 0 degrees to something less than 45 degrees) may also create the illusion of two visible filaments 220, 224. The illusion of two visible filaments 220, 224 in the LED lamp assembly 200 of the disclosed embodiments can be aesthetically pleasing to the observer.

Figure 11:
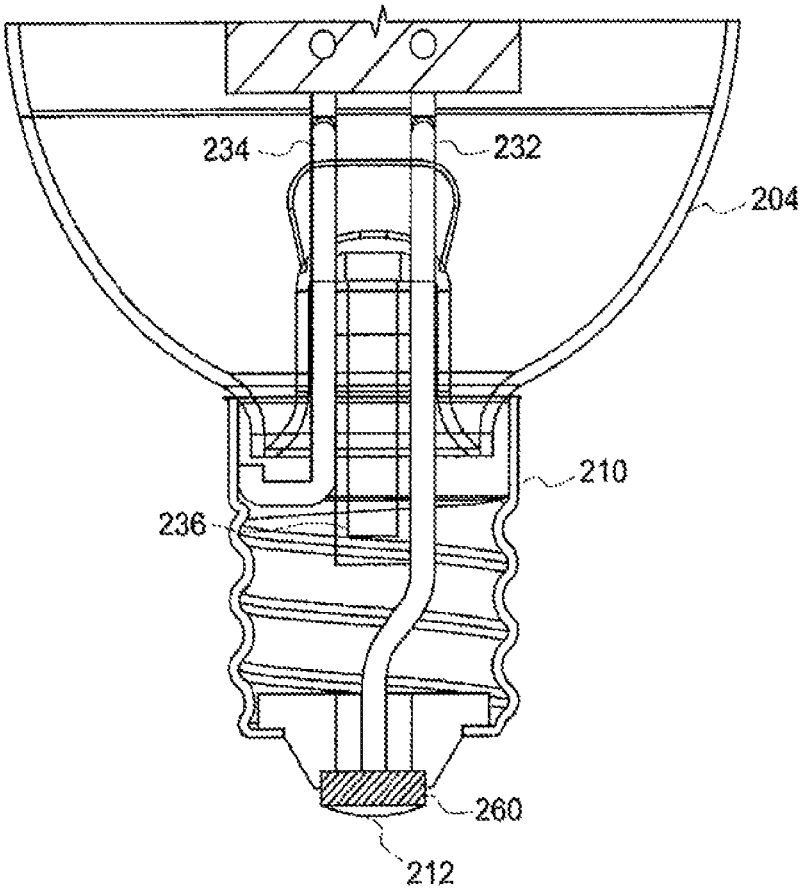
FIG. 11 illustrates a section view of an exemplary base assembly for the LED lamp assembly incorporating aspects of the disclosed embodiments.

Referring to FIGS. 10 and 11, in one embodiment, the LED lamp assembly 200 may include a safety circuit. The safety circuit may generally be configured to interrupt the electrical power to the LED lamp assembly 200 if the glass outer jacket 204 breaks or is otherwise compromised.

The outer jacket or envelope 204, which may be made of glass, may serve the same purpose as in standard light bulbs. The outer jacket 204, also referred to herein as a bulb, may hermetically seal the internal contents of the LED assembly 200 from the ambient air. Additionally, the outer jacket or bulb 204 can provide mechanical structure, thermal stability, may provide a diffuse surface for scattering light in a particular distribution (if a coating or treatment is applied). Typically, A19-shaped bulbs are semi-spherical and may be configured to provide nearly omnidirectional uniform light output. Glass has been used in the lighting industry over many years because it has high hermeticity, transparency, manufacturability, and cost-effectiveness that make it an ideal material for this application. Some plastics can rival glass on the latter three criteria, but plastics may be too porous to keep small gaseous molecules such as hydrogen and helium from escaping over time. However, glass generally can seal in such small gaseous molecules.

FIG. 11 is a cross-sectional view of the base section of the LED lamp assembly 200 illustrating the glass outer jacket 204 and the fuse 260. The fuse 260 may generally be configured to cut power to the LED lamp assembly 200 if the glass outer jacket 204 is compromised.

Figure 12:
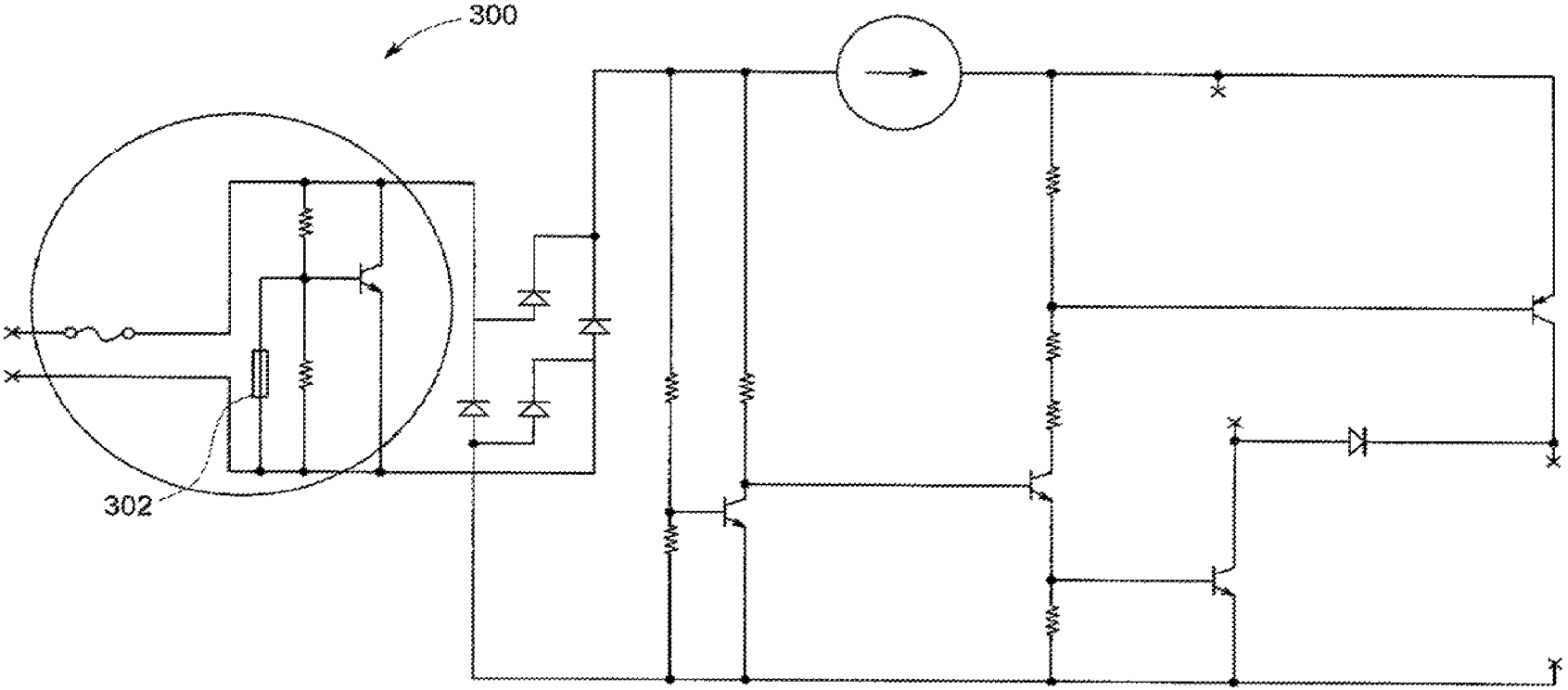
FIG. 12 illustrates a schematic for an exemplary safety circuit for the LED assembly of the disclosed embodiments.

The fuse 260, which in one embodiment comprises a fusible resistor, may generally function as follows. First, referring to FIG. 12, a selectively active oxygen-sensitive, electrically-conductive element 302 may be provided on the PCB 206, wherein selectively active means that the element 302 will not become sensitive to oxygen until it has been activated by thermal, electrical, chemical, or mechanical means. Then, the PCB 206 with filament 220 and optionally filament 222, may be hermetically sealed (e.g. flame-sealed) with the glass outer jacket 204 around it. After sealing, the glass outer jacket or bulb 204 may be exhausted by pulling vacuum through the stem tube 236 (which protrudes from the bottom of the glass between the leads 232, 234, and refilled with the thermally conductive medium (e.g. helium). The exhaust/fill process may repeat several times.

Once the bulb 204 is sufficiently filled, the stem tube 236 may be hermetically sealed (e.g. flame sealed). At this point, the neutral lead 234 and hot lead 232 from the PCB 206 may protrude out of the bottom of the glass bulb 204, but everything inside the glass bulb 204 may be protected from the outside air. The neutral wire 234 may be welded to the side wall of the base 210, while the hot wire 232 may be soldered to the fuse 260 on the bottom of the base 210.

Once the LED lamp assembly 200 has been sealed, the selectively active element 302 inside the bulb 204 can be activated, that is, made to be an oxygen sensitive electrical conductor. Prior to activation, it may not be oxygen sensitive, and may or may not be a conductor prior to activation. However, after activation, the element 302 may cease to conduct if exposed to oxygen. If the element 302 is contained in an inert atmosphere by an intact bulb, it may conduct electricity. If the glass bulb 204 is sufficiently compromised (e.g. cracked or broken), the oxygen in the ambient air may trigger the oxygen-sensitive element 302 to stop conducting. When the oxygen-sensitive element 302 inside the bulb 204 stops conducting, the fuse 260 in the base 210 may be tripped and may no longer conduct electricity to the rest of the LED lamp assembly 200. The fuse 260 may be any kind of fusible element that will open if the oxygen-sensitive element 302 is triggered.

The element 302 may function to trigger the fuse 260 to cut power to the LED lamp assembly 200 if glass outer jacket 204 is compromised. Many materials can be employed for element 302, including, but are not limited to, Indium-Tin Oxide (ITO) coating on the glass bulb, or a metal strip on the PCB that reacts with air (e.g. lithium), or the like. In order to preserve the integrity of the metal strip during manufacturing, the strip may be activated electrically, chemically, or thermally only after the bulb 204 has been filled with an inert thermally conductive medium (cooling fluid) and sealed. Alternatively the lamp 200 may be assembled in an inert environment. If the lamp is assembled in an inert environment, the element 302 may not require any activation in order for it to be oxygen sensitive.

Alternatively, there may be numerous other methods for ensuring safety to exposed electrical elements, in the event that the glass bulb 204 is sufficiently compromised (e.g. cracked or broken). One method may employ a pressure transducer which may be configured to sense that the pressure in the bulb has been suddenly raised from a sub-atmospheric pressure to atmospheric pressure. For example, a pressure transducer which may be sufficiently small to be placed "on-chip" inside the glass bulb, and may be capable of sensing an original pressure state for an intact bulb (e.g., 0.5 atmosphere of gas) and may also be capable of sensing a change in pressure to about 1 atmosphere (broken bulb). For example, a resistance or capacitance of an element in a pressure transducer can change; this may change an electrical circuit in a pressure-dependent way; a change in a circuit may be used to "trip" the fuse. Another method may employ an oxygen sensor, which may be configured to provide a first signal at low partial pressure of oxygen gas (e.g., an intact bulb may have substantially zero partial pressure of oxygen), and to provide a second signal when there is a level of oxygen representative of a broken bulb (e.g., partial pressure of 0.2 atm, which is the broken state). This may change a circuit in an oxygen-sensitive way, and a change in a circuit may be used to trip a fuse.

The aspects of the disclosed embodiments can also include a method for assembling an LED lamp. In one embodiment, as illustrated in FIG. 6, the method can include applying at least one reflective surface 208 onto the PCB 206. The filaments 220, 222 are then mechanically and electrically attached to their leads (which may be contained within supports or prongs 240).

Figure 9:
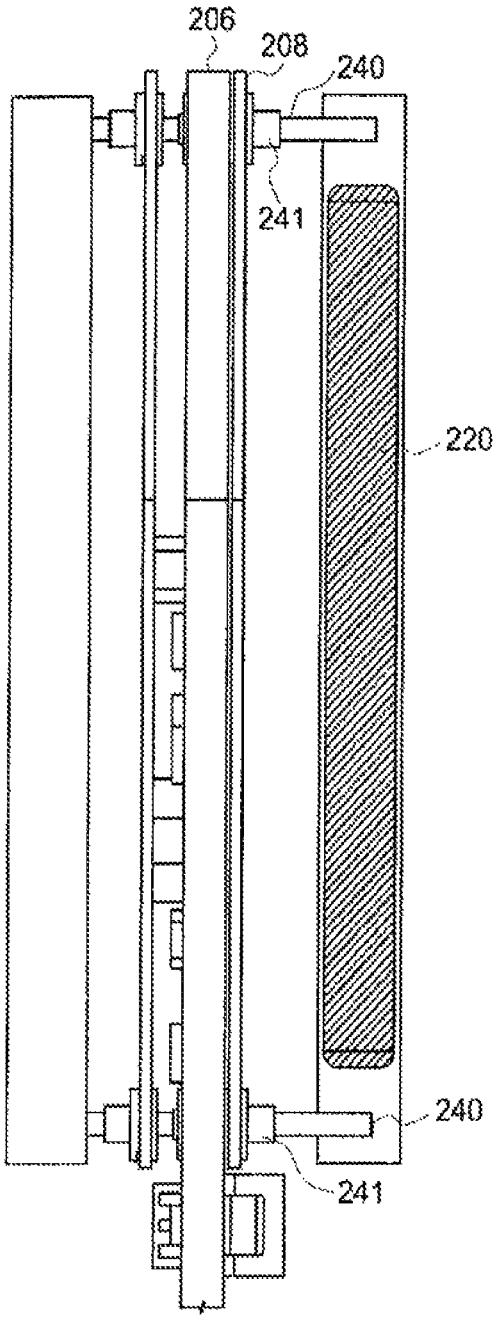
FIG. 9 illustrates the use of insulating sheaths in the LED lamp assembly shown in FIG. 5.

In one embodiment, as illustrated in FIG. 9, a method for assembling an LED lamp can include mechanically attaching at least one filament 220, 222 to a reflective panel 208. The filament 220, 222 may be electrically and mechanically attached to its leads 240 and the leads 240 may be mechanically attached to the insulating sheaths 241. The sheaths 241 may be mechanically attached to the reflective panel 208, creating a filament-panel subassembly which may comprise a filament 220, leads 240, insulating sheaths 241, and reflective panel 208. The filament-panel subassembly may then be electrically and mechanically connected to the PCB 206.

The aspects of this disclosure may also further include a lamp assembly, including a base, an outer jacket, an circuit board disposed within the outer jacket and electrically coupled to the base, the circuit board comprising at least a driver circuit, a first solid-state light source coupled to a side of the circuit board, and a first reflective surface disposed between the first light source and the circuit board.

The outer jacket may be transparent or translucent and may provide a hermetic seal to the lamp assembly. That is, at least the following components of a lamp may be hermetically sealed in an envelope with a heat conducting fluid: at least one circuit board comprising a solid state light source and a driver circuit coupled to the solid state light source.

The outer jacket may be translucent and an interior of the lamp assembly may be at least partially visible.

A lamp light output may change correlated-color temperature (CCT) as the first solid state light source is dimmed.

The lamp assembly may include a second solid-state light source coupled to an other side of the driver board, and a second reflective surface disposed between the second light source and the circuit board.

The second solid state light source may be an LED filament.

The second solid state light source may have a different CCT than the first solid state light source.

The reflective surface may be one or more of a thin plate, film, or coating.

The reflective surface may have a mirror-like finish.

The reflective surface may have a matte finish.

The lamp assembly may include an outer glass jacket and a fuse, the fuse may be configured to cut power to the lamp if the outer glass jacket is compromised.

The lamp assembly may include at a least a third solid state light source. At least one of the first light source, second light source and third light source may have a first CCT and at least another one of the first light source, second light source and third light source may have a second CCT that is different from the first CCT.

Thus, while there have been shown, described and pointed out, fundamental novel features of the exemplary embodiments thereof, it will be understood that various omissions and substitutions and changes in the form and details of devices illustrated, and in their operation, may be made by those skilled in the art without departing from the spirit and scope of the disclosed embodiments. Moreover, it is expressly intended that all combinations of those elements, which perform substantially the same function in substantially the same way to achieve the same results, are within the scope of the embodiments disclosed herein. Moreover, it should be recognized that structures and/or elements shown and/or described in connection with any disclosed form or embodiment may be incorporated in any other disclosed or described or suggested form or embodiment as a general matter of design choice. It is the intention, therefore, to be limited only as indicated by the scope of the claims appended hereto.

What is claimed is:

1. A lamp assembly, comprising:

a base;

an outer jacket mounted to the base;

a first reflective substrate positioned within the outer jacket, wherein the first reflective substrate comprises a specular reflective surface covering at least a portion of one or more faces of a circuit board, and electrical circuit components of an LED driver are mounted on at least one face of the circuit board; and a first solid-state light source disposed proximate the first reflective substrate.

2. The lamp assembly of claim 1, wherein the outer jacket is formed of glass.

3. The lamp assembly of claim 1, wherein the outer jacket comprises a polymer.

4. The lamp assembly of claim 1, wherein the outer jacket comprises a translucent ceramic.

5. The lamp assembly of claim 1, wherein the first solid-state light source is an LED light source.

6. The lamp assembly of claim 1, wherein the first solid-state light source is an LED filament light source.

7. The lamp assembly of claim 1, wherein the first solid-state light source is mounted within a cutout of the first reflective substrate.

8. The lamp assembly of claim 1, wherein the first reflective substrate has a combination of specular and diffuse surface reflectance.

9. The lamp assembly of claim 1, further comprising:

a second reflective substrate positioned within the outer jacket; and a second solid-state light source disposed on the second reflective substrate.

10. The lamp assembly of claim 9, wherein the first reflective substrate is mounted on a first face of a printed circuit board and the second reflective substrate is mounted on a second face of the printed circuit board.

11. The lamp assembly of claim 10, wherein the second reflective substrate is disposed in a stand-off relationship with the second face of the printed circuit board.

12. The lamp assembly of claim 1, further comprising:

a second reflective substrate positioned within the outer jacket;

a second solid-state light source disposed on the second reflective substrate;

a third reflective substrate positioned within the outer jacket; and a third solid-state light source disposed on the second reflective substrate.

13. The lamp assembly of claim 12, wherein the first reflective substrate is mounted between the second and third reflective substrates and the first solid state light source is mounted within a cutout of the first reflective substrate.

14. The lamp assembly of claim 1, wherein electrical circuit components of a dimmable LED driver are mounted on at least one face of the circuit board.

15. The lamp assembly of claim 1, wherein the LED driver is electrically coupled to the solid state light source.

16. The lamp assembly of claim 1, wherein the first solid-state light source and the electrical circuit components of an LED driver are hermetically sealed in the outer jacket.

17. The lamp assembly of claim 1, wherein a heat conducting fluid comprising a non-oxidative gas is present in the lamp assembly and is hermetically sealed in the outer jacket.

18. The lamp assembly of claim 17, wherein the heat conducting fluid comprises helium.

19. The lamp assembly of claim 1, wherein the specular reflective surface comprises at least one of an interference thin film or a specular metal coating, covering at least a portion of one or more faces of a circuit board.

20. A lamp assembly, comprising:

a base;

an outer jacket mounted to the base;

a first reflective substrate positioned within the outer jacket, wherein the first reflective substrate comprises a specular reflective surface covering at least a portion of one or more faces of a circuit board, and electrical circuit components of an LED driver are mounted on at least one face of the circuit board; and a first solid-state light source disposed proximate the first reflective substrate, wherein the first solid-state light source and the electrical circuit components of the LED driver are hermetically sealed in the outer jacket, and wherein a heat conducting fluid comprising a non-oxidative gas is present in the lamp assembly and is hermetically sealed in the outer jacket.

* * * * *